US008844624B2

(12) United States Patent
Buytaert et al.

(10) Patent No.: US 8,844,624 B2
(45) Date of Patent: Sep. 30, 2014

(54) RIGID CENTRALIZER

(75) Inventors: Jean Buytaert, Mineral Wells, TX (US); Christopher M. Penry, Mineral Wells, TX (US); Troy L. McDaniel, Weatherford, TX (US)

(73) Assignee: Antelope Oil Tool & Mfg. Co., LLC, Mineral Wells, TX (US)

( * ) Notice: Subject to any disclaimer, the term of this patent is extended or adjusted under 35 U.S.C. 154(b) by 493 days.

(21) Appl. No.: 12/960,716

(22) Filed: Dec. 6, 2010

(65) Prior Publication Data

US 2012/0138288 A1 Jun. 7, 2012

(51) Int. Cl.
*E21B 17/10* (2006.01)

(52) U.S. Cl.
CPC ..... *E21B 17/1078* (2013.01)
USPC ..... 166/241.6; 166/241.1; 166/241.7; 175/325.1; 175/325.5

(58) Field of Classification Search
USPC ..... 166/380, 241.1, 241.6, 241.7, 172; 175/325.1, 325.5, 325.6
See application file for complete search history.

(56) References Cited

U.S. PATENT DOCUMENTS

| | | | | |
|---|---|---|---|---|
| 1,201,706 | A | 10/1916 | Dodge | |
| 2,368,401 | A | 1/1945 | Baker | |
| 2,496,402 | A | 2/1950 | McVeigh et al. | |
| 2,594,551 | A * | 4/1952 | Gist | 166/241.7 |
| 2,797,756 | A | 7/1957 | Hall, Sr. | |
| 2,824,613 | A | 2/1958 | Baker et al. | |
| 2,855,052 | A | 10/1958 | Wright et al. | |
| 2,962,313 | A | 11/1960 | Conrad | |
| 3,292,708 | A | 12/1966 | Mundt | |
| 3,563,575 | A | 2/1971 | Sanford | |
| 3,652,138 | A | 3/1972 | Collett | |
| 3,916,998 | A | 11/1975 | Bass, Jr. et al. | |
| 4,363,360 | A * | 12/1982 | Richey | 166/241.7 |
| 5,501,281 | A | 3/1996 | White et al. | |
| 5,566,754 | A * | 10/1996 | Stokka | 166/241.6 |
| 5,706,894 | A | 1/1998 | Hawkins, III | |
| 5,860,760 | A | 1/1999 | Kirk | |
| 5,881,810 | A * | 3/1999 | Reinholdt et al. | 166/241.7 |
| 5,908,072 | A | 6/1999 | Hawkins | |
| 6,540,022 | B2 * | 4/2003 | Dusterhoft et al. | 166/278 |
| 6,679,335 | B2 | 1/2004 | Slack et al. | |
| 7,048,064 | B1 * | 5/2006 | Smith | 166/382 |
| 7,159,619 | B2 | 1/2007 | Latiolais, Jr. et al. | |
| 2008/0164019 | A1 * | 7/2008 | Angman | 166/241.6 |
| 2009/0142141 | A1 * | 6/2009 | Lutgring | 405/249 |

OTHER PUBLICATIONS

Frank's Anaconda Stop Collar Sheet, Frank's Casing Crew & Rental Tools, Inc., Lafayette, LA, 2003.

* cited by examiner

*Primary Examiner* — David Andrews
*Assistant Examiner* — Richard Alker
(74) *Attorney, Agent, or Firm* — MH2 Technology Law Group, LLP

(57) ABSTRACT

Embodiments of the disclosure provide a rigid centralizer having at least one annular band with radially extending embossed flutes spaced around an outer surface of the at least one annular band and a plurality of elongated connecting posts welded to an inner surface of the at least one annular band to form a tubular receiving annulus.

26 Claims, 2 Drawing Sheets

RIGID CENTRALIZER

FIELD OF THE DISCLOSURE

The present disclosure generally relates to rigid centralizers configured to center a tubular within a wellbore or within another larger diameter tubular.

BACKGROUND OF THE DISCLOSURE

Tubulars are positioned in wellbores to perform a variety of drilling and production tasks. Additionally, many drilling and production tasks require the tubular to be centrally positioned within a larger diameter tubular, e.g., a casing, liner, etc. In these situations, centralizers are generally positioned on or otherwise attached to the outer diameter (OD) of the tubular to maintain separation between the OD of the tubular and the inner diameter (ID) surrounding larger diameter tubular, casing, liner, etc.

Flexible centralizers are known and generally include a pair of annular bands that are axially spaced from each other, but are connected together by a plurality of flexible bow shaped segments, where a central portion of the flexible bow segments extends radially outward beyond the OD of the annular bands that are attached to the terminating ends of the bows. Rigid centralizers are also known in the art and generally include one or more annular bands axially spaced and connected together by a plurality of solid connecting members that are attached to the OD of the respective annular bands. Regardless of type, centralizers are positioned on the tubular such that the tubular extends through a central bore of the annular band members of the centralizer, and the centralizer may be secured to the tubular or positioned on the tubular and allowed to move axially along the tubular.

However, rigid-type centralizers are known to be heavy, expensive to ship and manufacture, and require a significant amount of expensive diameter space in the hole to centralize a tubular. As such, a lighter and inexpensive centralizer that allows for smaller tubulars to be centralized in larger holes is desired.

SUMMARY OF THE DISCLOSURE

Embodiments of the disclosure may generally provide a rigid centralizer having a first and second annular bands each having a plurality of embossed flutes protruding from an outer surface thereof, the plurality of embossed flutes being sized and configured to engage a surrounding tubular or casing. The centralizer may also include three or more substantially linear interconnecting posts having opposing terminating ends welded to an inner diameter surface of the first and second annular bands, the substantially linear interconnecting posts being radially spaced around the inner diameter surface of the first and second annular bands.

Embodiments of the disclosure may further provide a method for manufacturing a rigid centralizer. The method may include cutting or pressing two rectangular band pieces of sheet metal from a stock sheet or strip of metal, rolling the rectangular band pieces into annular band members having terminating ends positioned proximate each other, welding the terminating ends together to form unitary annular bands, pressing embossed flutes into the sheet metal before or after the sheet metal is formed into the unitary annular bands, and connecting the annular bands together by welding first terminating ends of connecting posts to an inner diameter of a first unitary annular band and welding second terminating ends of the connecting posts to an inner diameter of a second unitary annular band, the interconnecting posts being radially spaced around the inner diameter of the respective first and second annular bands to cooperatively form an annulus configured to receive a tubular there through.

Embodiments of the disclosure may further provide a rigid centralizer that includes a at least one annular bands having embossed flutes radially spaced around an outer surface of the annular band, and a plurality of connecting posts welded to an inner surface of the at least one annular metal band to form a tubular receiving annulus.

BRIEF DESCRIPTION OF THE DRAWINGS

The present disclosure is best understood from the following detailed description when read with the accompanying Figures. It is emphasized that, in accordance with the standard practice in the industry, various features are not drawn to scale in the following Figures. In fact, the dimensions of the various features may be arbitrarily increased or reduced for clarity of discussion.

DETAILED DESCRIPTION OF THE DISCLOSURE

Figure 1:
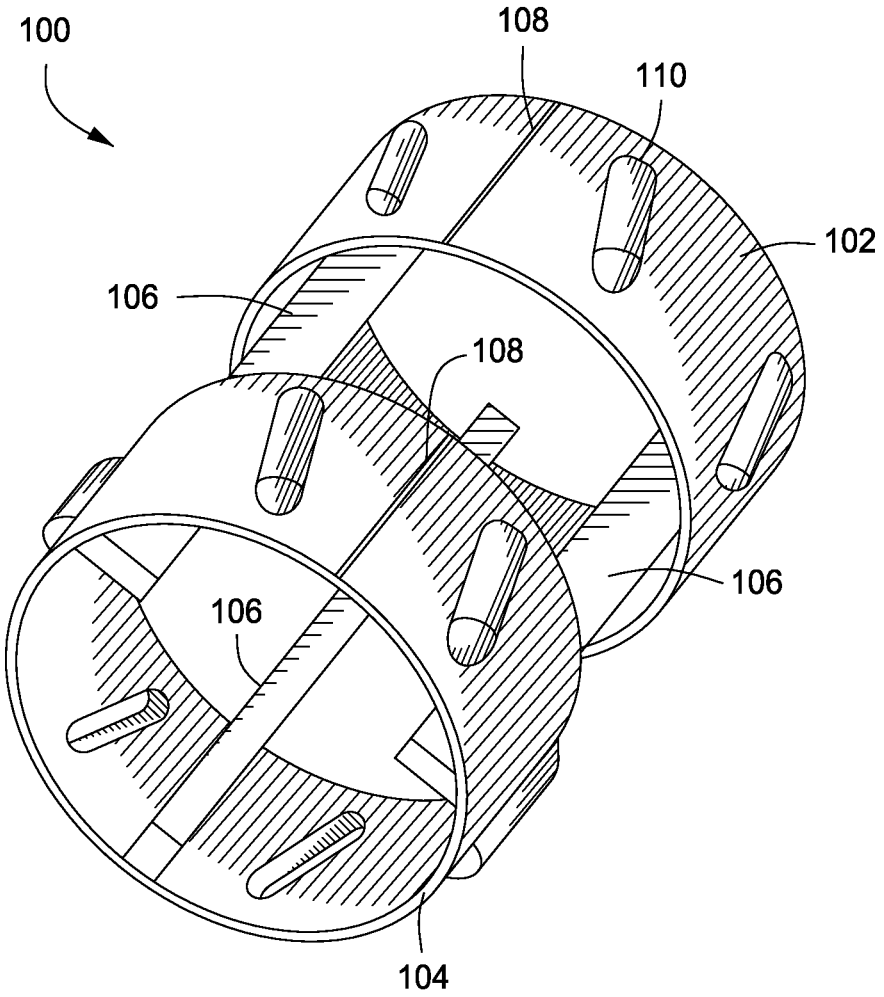
FIG. 1 illustrates a perspective view of an exemplary rigid slip-on-type centralizer of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination, e.g., any element from one exemplary embodiment may be used in any other exemplary embodiment, without departing from the scope of the disclosure.

Additionally, certain terms are used throughout the following description and claims to refer to particular components of the disclosure. As one skilled in the art will appreciate, various entities may refer to the same component by different names, and as such, the naming convention for the elements described herein is not intended to limit the scope of the invention, unless otherwise specifically defined. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, e.g., "A or B" is intended to be synonymous with "at least one of A and B," unless otherwise expressly specified herein.

FIG. 1 illustrates a perspective view of an exemplary rigid slip-on-type centralizer 100 of the disclosure. Centralizer 100 generally includes a first centralizer band 102 connected to a second centralizer band 104 via a plurality of substantially linear interconnecting posts 106. The centralizer bands 102, 104 may be a commercially available series 490 centralizer band manufactured by Antelope Oil Tool and Manufacturing Company, Inc. of Mineral Wells, Tex. Both of the first and second centralizer bands 102, 104 generally include a plurality of embossed flutes 110 positioned radially around the respective bands 102, 104, at generally equal radial increments or spacings. Each of the embossed flutes 110 extend radially outward from the outer surface or OD of their respective band 102, 104 and are configured to engage or contact the outer tubular (once the centralizer is installed). Applicants note, however, that in at least one embodiment of the disclosure only a portion of the flutes 110 may be in contact with the ID of the surrounding tubular or casing, and that embodiments of the disclosure are not limited to the situations where all of the flutes 110 might possibly be contacting the ID of the surrounding tubular or casing. Rather, in at least one embodiment the flutes 110 will generally engage or contact the surrounding tubular with only a fraction of the total number of the flutes 110 at most times. The ID of the centralizer bands 102, 104 may generally include an indentation corresponding to each of the embossed flutes 110 (when the flutes 110 are pressed into respective bands 102, 104). In other embodiments of the disclosure, the flutes 110 may include separate discrete elements that may be attached to the OD of the respective bands 102, 104 via, for example, welding or other commonly known securing means. Regardless of the type of flute 110 used, each of the respective centralizer bands 102, 104 may include between about 6 and about 12 flutes 110 thereon. In other embodiments of the disclosure, any number of flutes 110 may be used, as desired.

The centralizer bands 102, 104 may optionally include a plurality of radially spaced set screws (not shown) that may be used to secure the rigid centralizer 100 to a tubular. In another embodiment of the disclosure, the rigid centralizer 100 may be implemented without set screws and may be positioned on a tubular between stop collars to reduce drag by allowing the tubular to move within the centralizer 100, e.g., rotate. In another embodiment, the centralizer 100 may be positioned on a tubular and not secured thereto nor be positioned between stop collars, thus allowing the centralizer 100 to move axially and radially with respect to the tubular.

The plurality of interconnecting posts 106 are generally positioned at equal radial increments around the ID of the first and second centralizer bands 102, 104 and secured thereto via a weld or other means of securing or attaching a metal bar to the ID of an annular band. In at least one embodiment, the interconnecting posts may be positioned at varying radial increments around the ID of the bands 102, 104. Additionally, in some embodiments of the disclosure the interconnecting posts 106 may all be of the same height; however, in other embodiments the height of the interconnecting posts 106 may vary, thus allowing for an offset of the pipe within the centralizer 100. In embodiments where the length of the interconnecting posts 106 varies, the additional space generated by using a shorter post 106 may be used to route wires, control lines, etc. through the centralizer 100. In this embodiment, the centralizer 100 may also offer some protection of the wires or lines from contacting or being pinched between the centralizer 100 and the ID of the surrounding tubular or casing, as the wires will be positioned inside the annular bands of the centralizer. The interconnecting posts 106 may be welded on 2, 3, or 4 sides to secure the post 106 to the ID of centralizer bands 102, 104. In other embodiments of the disclosure, the posts 106 may be bolted or secured to the centralizer bands 102, 104 by other means known in the art. The interconnecting posts 106 may be manufactured from standard rectangular or square cross-section bar stock, circular rod stock, or any other suitably shaped elongated material capable of being secured to the centralizer bands 102, 104. Further, although the exemplary embodiment illustrated in FIG. 1 shows three interconnecting posts 106, embodiments of the disclosure are not limited to any particular number of interconnecting posts 106. For example, embodiments of the disclosure may provide for between three and six interconnecting posts 106 to be used to secure the centralizer bands 102, 104 together. The interconnecting posts 106 are generally welded to the ID of the centralizer bands 102, 104 so that the terminating ends of the interconnecting posts 106 do not extend beyond the edge of the associated centralizer band 102, 104. Further, the terminating ends of the interconnecting posts 106 may optionally be machined to generate an angled pipe receiving surface 107 that facilitates easy installation of the centralizer 100 onto a tubular. In other embodiments, the terminating ends (surface) of the interconnecting posts 106 may be perpendicular to the longitudinal axis of the centralizer 100 to provide a flat surface on the terminating ends of the centralizer 100 to facilitate installation of the centralizer 100 in embodiments where the centralizer 100 is used with stock collars or the like positioned near the terminating ends that also have perpendicular/flat surfaces for the installation.

The interconnecting posts 106 are generally sized to provide sufficient strength to the centralizer 100, without substantially reducing the inner available diameter (or radius) 126 (illustrated in FIG. 3) that is available to receive the tubular upon which the centralizer 100 will be mounted. The inner available diameter 126 is important to embodiments of the disclosure, as this diameter forms an annulus (shown as a dashed line in FIG. 3 at the end of radius 126) for receiving the tubular being centralized, e.g., the annulus of the centralizer is sized to receive and centralize a specific diameter tubular. In an exemplary embodiment of the disclosure, the radial width of the interconnecting posts 106 is sized to decrease the radius 126 (tubular receiving annulus) by less than about 1.5 inches, e.g., the (rectangular long side) width of the connecting post 106 is less than 1.5 inches long. In another embodiment of the disclosure, the posts 106 may be sized to have a width of less than about 1 inch.

Figure 2:
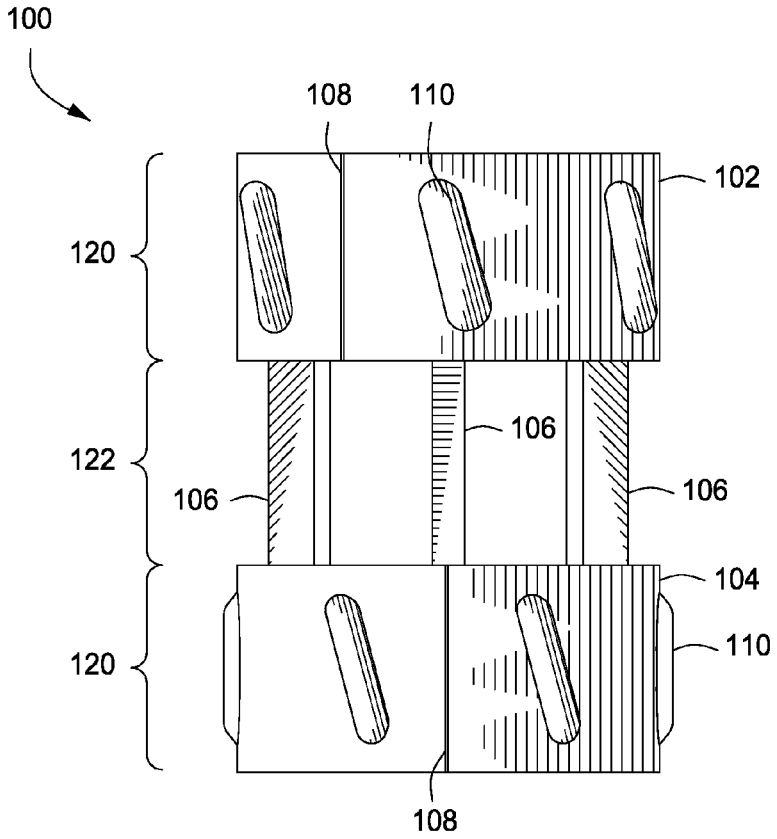
FIG. 2 illustrates a front view of the exemplary rigid slip-on-type centralizer of the disclosure.

FIG. 2 illustrates a front view of the exemplary rigid slip-on-type centralizer 100 of the disclosure. In this view, the centralizer band height 120 is illustrated. Additionally, the space between the respective centralizer bands 102, 104 is also illustrated as 122. In at least one embodiment of the disclosure, the overall height of the rigid centralizer 100 [the height of the first band 102 {120} plus the height of the space between the bands {122} plus the height of the second centralizer band 104 {120}] may be between about 6 and about 12 inches. In another embodiment of the disclosure, the overall height of the rigid centralizer 100 may be between about 4 and about 10 inches. In other embodiments of the disclosure of the overall height of the rigid centralizer 100 may be between about 3 and about 18 inches. The overall height of the rigid centralizer 100 is generally calculated to reduce drag and facilitate running into the hole, while maintaining rigid standoff, e.g., to create a positive standoff when running liners, for example.

FIG. 2 also illustrates the weld joints 108 on each of the respective centralizer bands 102, 104. In some embodiments of the disclosure, as discussed below, the centralizer bands 102, 104 may be formed from a flat piece of sheet metal that is pressed to form the flutes 110 and then rolled or otherwise formed into an annular shape to generate the desired annular centralizer band 102, 104. As such, once the sheet material has been rolled into an angular shape, the terminating ends of the material must be welded together to form the annular band, which inherently results in the weld joints 108.

The weld joints 108 for the respective centralizer bands 102, 104 are generally positioned in a radially offset manner, e.g., not in the same radial position. More particularly, as shown in FIG. 2, the weld joint 108 in the first centralizer band 102 is positioned radially offset from the weld joint 108 in the second to centralizer band 104. This offset positioning of the respective weld joints 108 provides increased strength to the rigid centralizer 100, as it avoids having two weak points (the weld joints 108) in the same radial position on the centralizer 100.

Additionally, in some embodiments of the disclosure, the respective centralizer bands 102, 104 may also be positioned such that the embossed flutes 110 are radially offset from each other. Specifically, as shown in FIG. 2, the flutes 110 for the first centralizer band 102 are positioned opposite or between the flutes 110 for the second centralizer band 104. As such, the radial position of the flutes 110 is distributed more evenly around the OD of the two bands 102, 104, which has been shown to provide improved wall contact.

FIG. 2 also provides some additional perspective as to the height or extension of the embossed flutes 110, wherein the height or extension is generally defined to mean the linear distance that the flute 110 protrudes or extends radially outward away from the OD of the respective centralizer band 102, 104. In an exemplary embodiment of the disclosure, the flutes 110 may be configured to extend radially outward from the OD of the centralizer band 102, 104 a distance of between about ⅛" and about ⅞". In another embodiment of the disclosure, the flute extension distance may be between about ⅜" and about ⅝". In other embodiments of the disclosure, the flute extension distance may be any distance up to about 1 inch.

Figure 3:
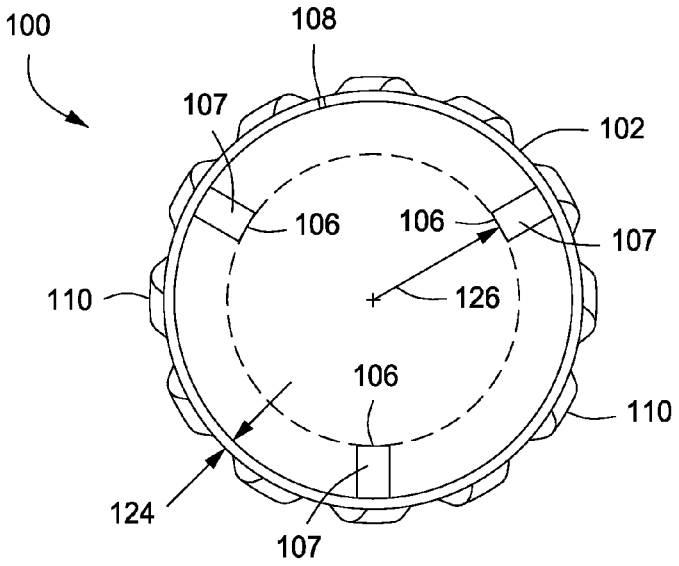
FIG. 3 illustrates a top view of the exemplary rigid slip-on-type centralizer of the disclosure.

FIG. 3 illustrates a top view of the exemplary rigid slip-on-type centralizer 100 of the disclosure. FIG. 3 illustrates the three exemplary interconnecting posts 106 positioned at 120° increments around the ID of the centralizer band 102. As noted above, additional interconnecting posts 106 may be used without departing from the scope of the disclosure, however, regardless of the number of interconnecting posts 106 used, the posts 106 may be equally spaced around the ID of the respective centralizer band 102. However, in at least one embodiment of the disclosure, the interconnecting posts 106 may be variably spaced. Additionally, FIG. 3 illustrates the wall thickness 124 of the centralizer band 102. This wall thickness 124 will generally be between about ⅛" and about ⅜", depending on the desired strength of the rigid centralizer 100.

In each of the embodiments of the rigid centralizer 100 described herein, the respective components (bands 102, 104 and interconnecting posts 106) may be manufactured from a metal, such as steel, iron, and other metal alloys. The materials selected are generally easily weldable, sufficiently malleable to allow for the flutes 110 to be pressed into the bands 102, 104, readily formable into the annular bands 102, 104 to allow for easy and cost efficient manufacture of the centralizer 100.

In another embodiment of the disclosure, the rigid centralizer 100 may be formed from a single band 102 having a plurality of posts 106 radially spaced and welded or otherwise secured to the ID of the bands 102, 104.

In yet another embodiment of the disclosure, the rigid centralizer 100 may be formed from three or more bands 102, 104, wherein each of the three or more bands 102, 104 are again connected via a plurality of radially spaced interconnecting posts 106 welded or otherwise secured to the ID of each of the respective bands 102, 104.

In yet another embodiment, the rigid centralizer 100 of the disclosure may be a hinged centralizer. For example, the centralizer 100 may be configured with a hinge (not shown) on one side of the annular bands 102, 104 and a connection mechanism on a generally opposing side of the bands 102, 104. The exemplary hinged centralizer 100 may still include the flutes 110, one or more annular bands 102, 104, and the interconnecting posts 10 described herein, however, in some embodiments the tubular may present some irregularities or upsets that do not allow for a slip on centralizer. For these embodiments, the hinged centralizer may be used.

Embodiments of the disclosure may also provide a method for manufacturing a rigid centralizer disclosed herein. The method may include forming the centralizer bands 102, 104 from metal sheet stock. More particularly, two strips of metal sheet stock may be cut to a width that is equal to about width 120 (from FIG. 2) and to a length that is equal to about the desired circumference ($\pi$*2*R, where R is the radius 126) of the centralizer 100 (as shown in FIG. 3). Either before or after the strips are cut, the strips may be pressed to form the embossed flutes 110 thereon. The strips may be formed, generally by press rolling or another metal working process, into a generally annular shape with the terminating ends of the strips being proximate each other. The terminating ends may then be welded together at weld joint 108 (with the flutes extending radially outward) to form a unitary annular centralizer band 102, 104. The embossed flutes 110 may also be pressed into the unitary annular bands 102, 104 after the bands 102, 104 are welded together, if desired. The two bands 102, 104 may then be joined together via a plurality of interconnecting rods 106. The rods 106, generally 3-4, may be welded to the ID of the bands 102, 104 at generally equal (if desired) radial increments. Additionally, the terminating ends of rods 106 may be machined to form angled tubular receiving surfaces 107 in some embodiments.

In another embodiment of the disclosure, and method for using a rigid centralizer of the present disclosure is provided. The method generally includes installing the rigid centralizer 100 onto a tubular. This involves sliding the centralizer over a terminating end of a tubular generally prior to the tubular being connected to the next tubular in the string. The inner surfaces of the interconnecting rods generally engage the OD of the tubular on which the centralizer 100 is being positioned, and as such, the radius 126 of the centralizer 100 determines the tubular size that may be received by the centralizer. Once the centralizer is positioned on the tubular, it may be secured to the tubular with set screws (not shown), or axially secured to the tubular between two stop collars that are secured to the tubular. Once the centralizer 100 is secured to the tubular, the tubular may be ran into the hole, and the outer surface of the flutes 110 may engage the ID of the casing, liner, or other tubular that the centralizer 100 has been inserted into. The flutes 110 engage the ID of the surrounding component and maintain the tubular in rigid standoff from the surrounding casing or tubular.

However, Applicants note that the positioning of the interconnecting posts 106 in the inside (attached to the ID) of the centralizer band has shown to provide for smaller diameter tubulars to be inserted into larger holes as a result of the reduced radial profile of the current rigid centralizer 100. For example, the exemplary rigid centralizer 100 provides an ideal application for end users wanting to save one size of casing, e.g., to centralize a 5½" tubular inside a 9⅝ casing or alternatively to centralize a 7" tubular inside a 13⅜" casing. Additionally, the construction of the rigid centralizer 100 is very light compared to a conventional rigid centralizer, which provides for significantly reduced shipping costs and easier installations due to the reduced weight. The current rigid centralizer is also inexpensive to produce, requires fewer welds than conventional centralizers, and provides a larger flow area than conventional centralizers, which facilitates both increased efficiency and reduced costs.

The foregoing has outlined features of several embodiments so that those skilled in the art may better understand the present disclosure. Those skilled in the art will also appreciate that the present disclosure may be used as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure, as defined by the following claims.

We claim:

1. A rigid centralizer, comprising:

a first annular band and a second annular band, wherein the first and second annular bands each comprise a plurality of flutes protruding from an outer surface thereof, the plurality of flutes being sized and configured to engage a surrounding tubular or casing; and a plurality of rigid posts extending between the first and second annular bands and coupled therewith, wherein the plurality of posts are fixed to an inner diameter surface of the first annular band and an inner diameter surface of the second annular band, the plurality of posts being spaced apart along the inner diameter surfaces, wherein the plurality of posts extend inward from the inner diameter surfaces, and the plurality of flutes extend to a position that is outward of the plurality of posts.

2. The rigid centralizer of claim 1, wherein the first and second annular bands are formed from a section of sheet stock and rolled or otherwise formed into annular bands having a weld joint connecting terminating ends of the sections of sheet stock to form the annular bands.

3. The rigid centralizer of claim 2, wherein a weld joint of the first annular band is radially offset from a weld joint of the second annular band.

4. The rigid centralizer of claim 1, wherein the flutes on the first annular band are radially offset from the flutes on the second annular band.

5. The rigid centralizer of claim 1, wherein the plurality of posts and the first annular band at least partially define an annulus sized to receive and centralize a tubular there through.

6. The rigid centralizer of claim 5, wherein the plurality of posts are each rectangular in cross section, with at least a first side of each of the plurality of posts being welded to the inner diameter surface of the first annular band.

7. The rigid centralizer of claim 6, wherein a height of a second side of the plurality of posts determines a size of the annulus, wherein the first and second sides are adjoining.

8. The rigid centralizer of claim 6, wherein a third side, opposite to the first side, of at least one of the plurality of posts is configured to slide along the tubular along substantially an entire length of the third side.

9. The rigid centralizer of claim 5, wherein the plurality of posts are circular, square, or trapezoidal in cross section.

10. The rigid centralizer of claim 1, wherein the plurality of posts are equally spaced along the inner diameter surface of the first annular band and include tapered terminating ends to facilitate receiving the tubular in the annulus.

11. The rigid centralizer of claim 1, wherein the plurality of posts each have first and second terminating ends, wherein at least one of the plurality of posts extends parallel to a longitudinal axis of the first annular band and radially within the first annular band, the second annular band, or both.

12. The rigid centralizer of claim 1, wherein a first post of the plurality of posts defines a first height between a radial inside and a radial outside thereof, and a second post of the plurality of posts defines a second height between a radial inside and a radial outside thereof, wherein the first and second heights are different.

13. The rigid centralizer of claim 1, wherein the plurality of posts spaced apart from the surrounding tubular or casing, when deployed therein, by the first annular band, the second annular band, or both.

14. The rigid centralizer of claim 13, wherein the plurality of flutes define an outer-most radial extent of the rigid centralizer.

15. The rigid centralizer of claim 1, wherein the plurality of flutes are configured to slide along the surrounding tubular or casing when deployed into the surrounding tubular or casing.

16. The rigid centralizer of claim 15, wherein the plurality of flutes each define an arcuate cross-section, to minimize a surface area contact with the surrounding tubular or casing.

17. A rigid centralizer for tubulars, comprising:

a first annular band having outwardly-extending flutes spaced around an outer surface thereof;

a second annular band that is axially spaced from the first annular band and having outwardly-extending flutes spaced around an outer surface thereof; and a plurality of elongated, rigid connecting posts secured to an inner surface of the first annular band and an inner surface of the second annular band, wherein the plurality of elongated connecting posts extend inward from the inner surfaces so as to form a first tubular-receiving annulus between the first annular band and a tubular received through the first annular band, and a second tubular receiving annulus between the second annular band and the tubular received therethrough, wherein each of the radially-extending flutes extend to a position that is outward of the plurality of connecting posts and are configured to slide along a wellbore when the tubular is deployed into the wellbore while preventing a remainder of the first and second annular bands from engaging the surrounding tubular or casing.

18. The rigid centralizer of claim 17, wherein the first and second annular bands comprise metal sheet stock that is pressed to form the flutes, cut and rolled into an annular shape, and welded to form annular bands having the flutes extending from the outer surface thereof.

19. The rigid centralizer of claim 17, wherein the plurality of connecting posts are equally spaced around the inner surfaces of the first and second annular bands to form the first and second tubular receiving annuli.

20. The rigid centralizer of claim 17, wherein the plurality of connecting posts have a rectangular, square, or circular cross section.

21. A rigid centralizer, comprising:

a first annular band and a second annular band, the first and second annular bands being spaced axially apart from one another and each defining an inner diameter surface and an outer diameter surface, wherein the first and second annular bands are each configured to receive a tubular within the inner diameter surface thereof, and wherein each of the first and second annular bands comprises a plurality of flutes extending radially outward from the outer diameter surface, the plurality of flutes being configured to engage a surrounding tubular or casing; and a plurality of rigid posts attached to the inner diameter surface of the first annular band and to the inner diameter surface of the second annular band and extending radially inward therefrom such that the first and second annular bands are spaced radially apart from the tubular at least by the plurality of posts when the tubular is received through the first and second annular bands, wherein the plurality of posts extend generally parallel to the first and second annular bands at least where the plurality of posts are attached to the first and second annular bands, wherein the rigid centralizer is configured to slide with the tubular and with respect to the surrounding tubular or casing, and wherein the plurality of flutes extend to a position outward of the plurality of posts.

22. The rigid centralizer of claim 21, wherein the plurality of posts are not configured to flex outward to engage the surrounding tubular or casing.

23. The rigid centralizer of claim 21, wherein the plurality of flutes are integrally formed with the annular band.

24. The rigid centralizer of claim 21, wherein the plurality of posts are configured to maintain a constant axial separation of the first and second bands.

25. The rigid centralizer of claim 21, wherein the first annular band is coupled to the plurality of posts at a first end of the plurality of posts, and the second annular band is coupled to the plurality of posts at a second end of the plurality of posts.

26. The rigid centralizer of claim 21, wherein a first post of the plurality of posts defines a first height between a radial inside and a radial outside thereof and a second post of the plurality of posts defines a second height between a radial inside and a radial outside thereof, such that the annular band is configured to be disposed non-concentrically with the tubular.

* * * * *